US006782868B1

(12) United States Patent
Doering

(10) Patent No.: US 6,782,868 B1
(45) Date of Patent: Aug. 31, 2004

(54) INTERNAL COMBUSTION ENGINE HAVING ENGINE SPEED LIMIT CONTROL SYSTEM

(75) Inventor: Jeffrey Allen Doering, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/384,019

(22) Filed: Mar. 10, 2003

(51) Int. Cl.[7] ..... F00D 1/00
(52) U.S. Cl. ..... 123/333; 123/436
(58) Field of Search ..... 123/333, 436, 123/352, 353, 354, 355, 356

(56) References Cited

U.S. PATENT DOCUMENTS 5,213,178 A * 5/1993 Polidan et al. ..... 180/197
6,152,853 A * 11/2000 Banks, III ..... 477/186
6,292,741 B1 * 9/2001 Bitzer et al. ..... 701/115
6,652,414 B1 * 11/2003 Banks, III ..... 477/32
6,691,669 B2 * 2/2004 Surnilla et al. ..... 123/295
6,735,938 B2 * 5/2004 Surnilla ..... 60/274
6,736,121 B2 * 5/2004 Gopichandra ..... 123/688
6,745,747 B2 * 6/2004 Surnilla ..... 123/344

* cited by examiner

*Primary Examiner*—John T. Kwon

(57) ABSTRACT

A method and system for controlling an internal combustion engine, such engine being coupled to a transmission. The engine is controlled in response to a torque command fed to a controller for controlling such engine. The method includes calculating a torque, tq_tx on the engine from the transmission, and initializing and/or limiting a torque command to such controller as a function of the calculated torque, tq_tx.

26 Claims, 5 Drawing Sheets

INTERNAL COMBUSTION ENGINE HAVING ENGINE SPEED LIMIT CONTROL SYSTEM

TECHNICAL FIELD

This invention relates to internal combustion engines and more particularly to systems and method for providing speed limit control in such systems.

BACKGROUND AND SUMMARY OF THE INVENTION

As is known in the art, it is sometimes desirable to provide speed limit control in internal combustion engines. One such application for such a speed limit control is in engine systems having electronic throttle control (ETC).

As is also known in the art, some internal combustion engines having ETC use a torque monitoring function. This function checks the desired engine torque, (i.e., driver demanded torque from, for example, a sensing of driver accelerator pedal position) with two independent measures of torque, for example, a throttle based (e.g., throttle position) estimate and an air-meter (i.e., Mass Air Flow, MAF) based method. If there is a loss of a throttle position signal, or MAF signal, for example, conditions warrant going into an ETC Alternative Management (AM) mode. In such AM mode, the powertrain is no longer be controlled based on torque but rather monitored engine speed. If engine speed is "too high" (i.e., above an allowable limit), all fuel injectors are disabled so that there is no torque produced by the engine. If fuel injector activity is observed when engine speed is above the allowable limit, the system transitions to a shutdown mode; i.e., fuel injection and electronic throttle control are permanently disabled.

The allowable limit for engine speed is hereinafter sometimes referred to as an RPM limit. The RPM limit is based on the driver's accelerator pedal position such that if the driver is not depressing the accelerator pedal, the engine speed is kept low (around 1000 to 1200 rpm) to limit wheel torque and creep. When the driver depresses the accelerator pedal, higher engine speed is allowed because the driver is demanding more power. To avoid monitor intervention that would put the system in shutdown, the main control system controls engine speed and the fuel injectors to satisfy the above-described criteria and thus allow continued operation.

Disabling all fuel injectors until engine speed drops below the RPM limit presents a control design challenge (i.e., in preventing the engine from stalling until such time as fuel injection can be resumed) because the load on the engine may be significant and engine speed may drop very rapidly.

In accordance with the invention, a method and system are provided for controlling an internal combustion engine, such engine being coupled to a transmission. The engine is controlled in response to a torque command fed to a controller for controlling such engine. The method includes calculating a torque, tq_tx, on the engine from the transmission, and initializing and/or limiting a torque command to such controller as a function of the calculated torque, tq_tx.

In accordance with another feature of the invention, a method and system are provided for controlling engine speed. The system and method determine a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input. An error, n_error, between measured engine speed and ctrl_n_lim is calculated. The error is fed to a feedback controller. The controller produces an engine brake torque, tqe_rpm, command for the engine. The controller disables engine fuel injection when the measured engine speed is greater than LIM_HIGH and enables fuel injection if the measured speed is within the range.

In one embodiment, a torque, tq_tx, on the engine from a transmission coupled to the engine is calculated. When measured engine speed decreases from a speed greater than LIM_HIGH, wherein fuel injection was disabled, to within the range, the controller enables fuel injection and provides, as an initial value for the engine brake command torque, the calculated torque, tq_tx.

In one embodiment, the controller provides proportional plus integral control action of the error, and wherein the integral action is initialized with the calculated torque to provide the initial value for the engine command torque.

In accordance with another feature of the invention, a method and system are provided for controlling engine speed. The system and method determine a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input. An error, n_error, between measured engine speed and ctrl_n_lim is calculated. The error is fed to a feedback controller. The controller produces an engine brake torque, tqe_rpm, command for the engine. The controller disables engine fuel injection when the measured engine speed is greater than LIM_HIGH and enables fuel injection if the measured speed is within the range. A torque load, tq_tx, on the engine is calculated from a transmission coupled to the engine. A determination is made as to whether measured engine speed is a potential stall speed. If measured engine speed is within the range and such measured engine speed is a potential stall speed, the controller operates to maintain tq_tx as the engine brake torque command to the engine.

In one embodiment, the controller provides proportional plus integral control action on the error, and wherein the integral action is clipped to maintain at least tq_tx as the engine brake torque command to the engine.

In accordance with still another feature of the invention, a method and system are provided for controlling engine speed. The system and method determine a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input. An error, n_error, between measured engine speed and ctrl_n_lim is calculated. The error is fed to a feedback controller. The controller produces an engine brake torque, tqe_rpm, command for the engine. The controller disables engine fuel injection when the measured engine speed is greater than LIM_HIGH and enables fuel injection if the measured speed is within the range. A torque load, tq_tx, on the engine from a transmission coupled to the engine is calculated. A determination is made as to whether measured engine speed is a potential stall speed. If measured engine speed is greater than a potential stall speed, and if the fuel injection was not disabled, having the controller operate to provide proportional plus integral operation on the error in providing the engine brake torque command to the engine.

In accordance with still another feature of the invention, a controller is provided to control engine speed to satisfy the RPM guard monitor requirements and provide acceptable engine speed control. More particularly, the controller determines an allowed maximum engine speed, (i.e., an RPM limit (variable ctrl_n_lim)), as a function of: accelerator pedal position. The controller calculates torque (tq_tx) on the engine from the automatic transmission, if present, based on a model of engine torque converter and transmission pump. The controller calculates an error ($n_{13}$ error), between current engine speed and the allowed maximum engine speed, $ctrl_{13}$ n_lim. The controller calculates desired engine brake torque (tqe_rpm) based on the error n_error and a set of logic that includes a proportional plus integral (PI) controller. The controller translates the desired engine brake torque (tqe_rpm) into torque reduction actions by retarding spark, cutting out injectors and using lean air-fuel ratios.

Thus, torque-based controller output (tqe_rpm) is used to disable all fuel injection until engine speed drops below the RPM guard limit while feedforward transmission torque calculations and other logic are used to prevent the engine from stalling until such time when fuel injection can be resumed.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
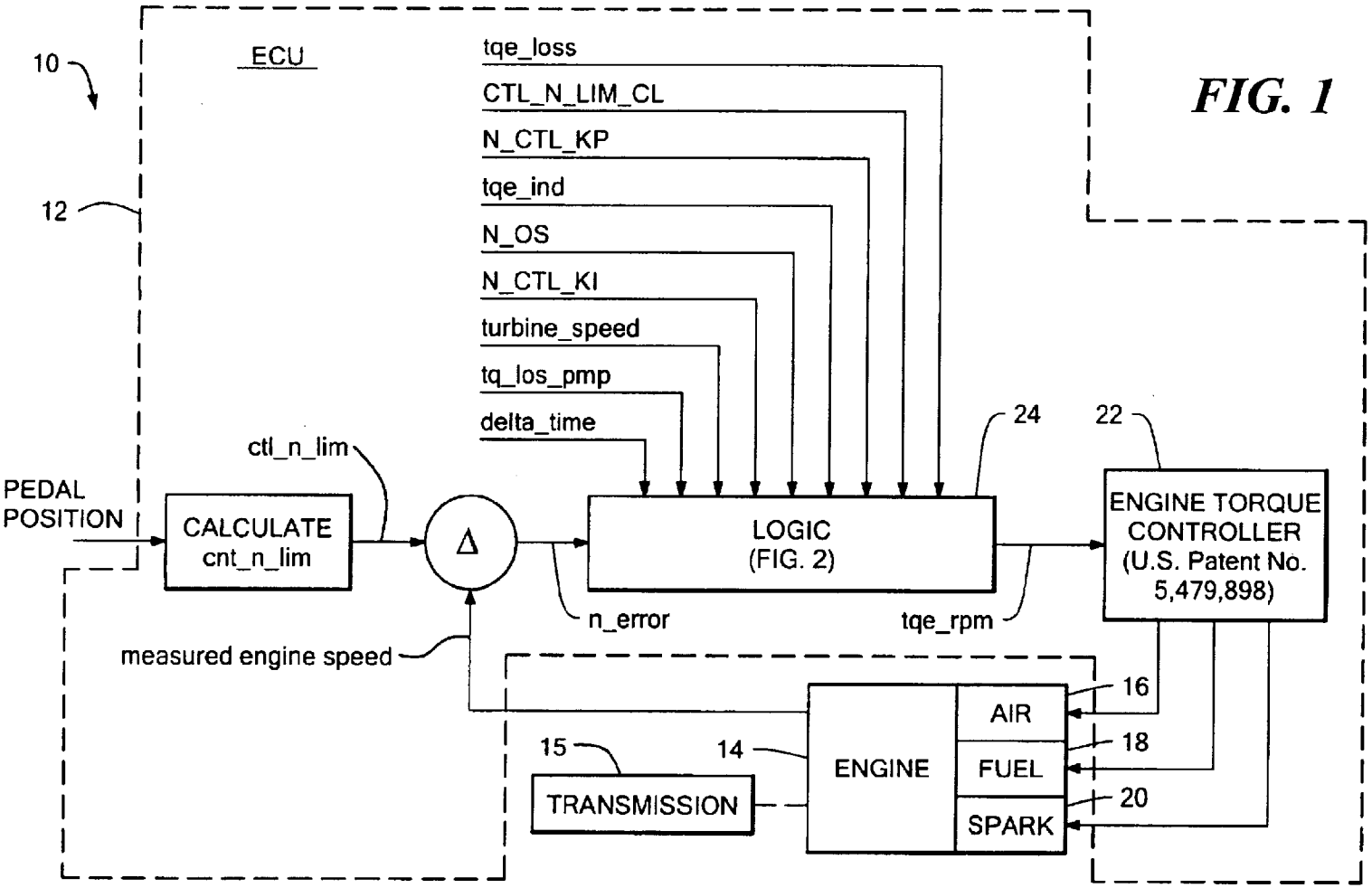
FIG. 1 is a block diagram of an engine system according to the invention.

Referring now to FIG. 1, an engine system 10 is shown to include an electronic control unit (ECU) 12 including a microprocessor for controlling a spark-ignited internal combustion engine 14. The engine 14 includes well-known fresh air intake 16 hardware, a plurality of fuel injectors shown generally by reference numeral 18, and a plurality of spark plugs shown generally by reference numeral 20. Preferably, the system operates according to the present invention to control the net engine torque produced by the engine 14 to a desired torque.

As is known, the microprocessor has both volatile and non-volatile semiconductor chip memories, such as a keep-alive memory and ROM, associated therewith. The ECU 12 could also include additional memories separate from and external to the microprocessor.

During vehicle operation, the microprocessor executes software typically stored in non-volatile memory, continually gathering in a real-time fashion a plurality of both vehicle and engine operating parameters from well-known sensors (not specifically illustrated for the sake of clarity) for purposes of vehicle and engine control. These parameters include, but are not limited to, mass airflow, engine speed, coolant temperature, exhaust gas oxygen, vehicle speed, and throttle position.

Utilizing the sensed data, the microprocessor controls various aspects of both vehicle and engine operation. As shown, the microprocessor controls the air/fuel (A/F) scheduling, the fuel delivery, and the spark advance. For A/F scheduling, the microprocessor controls the amount of fresh air delivered to the individual cylinders of the engine 14. For fuel delivery, the microprocessor controls the plurality of engine fuel injectors through a like plurality of standard fuel injector driver circuits. The associated fuel injectors provide fuel to the combustion cylinders in terms of a pulse width determined by the microprocessor based on the operating parameters. For spark, the microprocessor controls the amount of spark retard/advance.

More particularly, the ECU 12 includes an engine torque controller 22 described in U.S. Pat. No. 5,479,898 issued Jan. 2, 1996, inventors Cullen et al., entitled "Method and Apparatus for Controlling Engine Torque", assigned to the same assignee as the present invention, the entire subject matter thereof being incorporated herein by reference. The torque controller 22 produces the engine torque in accordance with a signal tqe_rpm produced by logic 24 to be described in more detail in connection with FIG. 2. Suffice it to say here, however, that signal tqe_rpm is produced by first determining the difference between: (1) an engine speed limit, ctrl_n_lim, determined as a function of accelerator pedal position, and (2) engine speed.

It is noted that the allowed engine speed limit ctrl_n_lim is a limit which changes as a function of pedal position. The difference between the allowed engine speed limit ctrl_n_lim and actual engine speed, n, is used to produce an error signal n_error. The error signal $n_{13}$ error is fed to the logic 24 along with other constants to be described to produce the signal trq_rpm.

Figure 2:
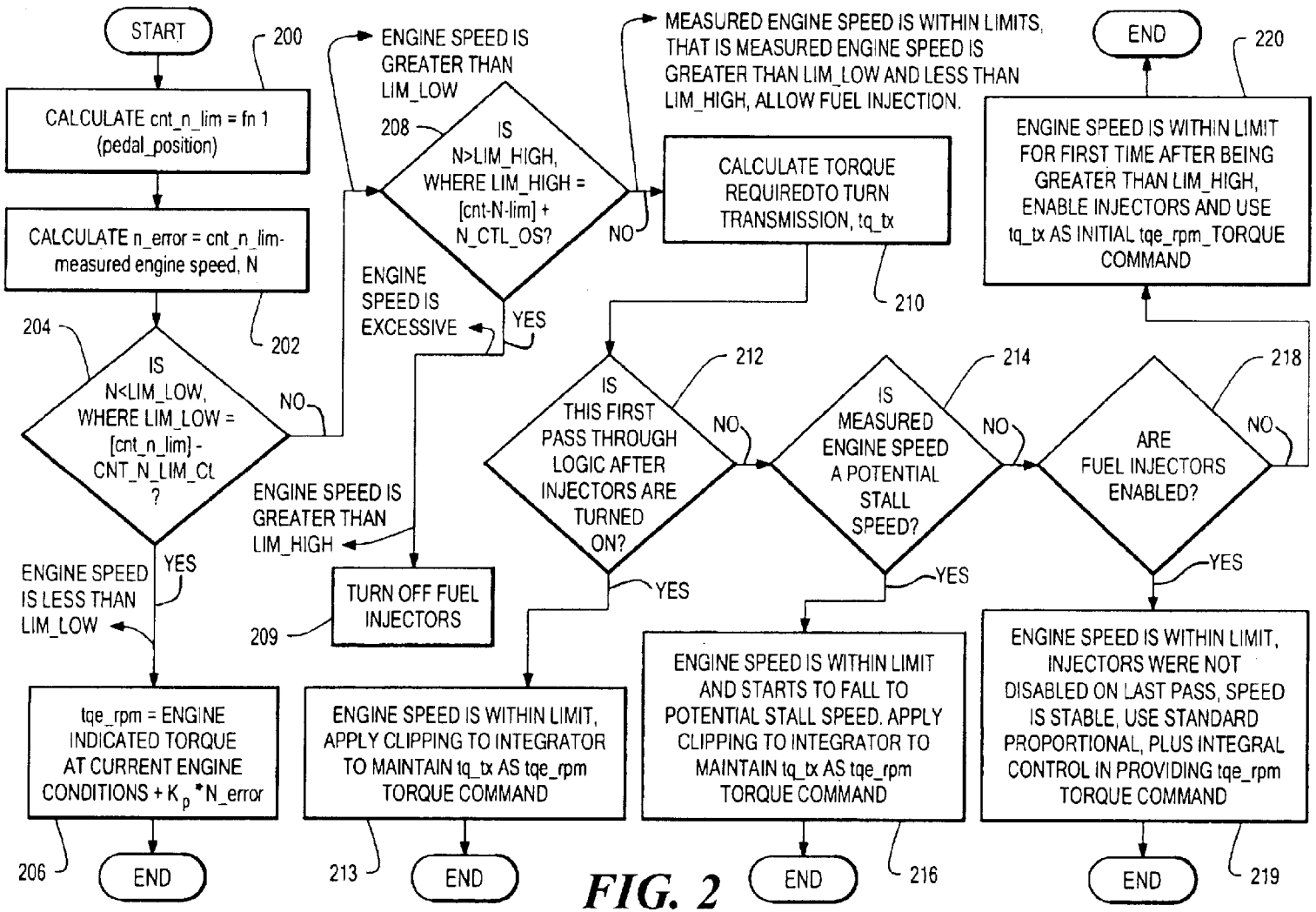
FIG. 2 is a flow diagram performed by logic included in the engine system of FIG. 1.

Referring now to FIG. 2, the flow diagram for the logic 22 is shown. Thus, at Step 200, the signal ctrl_n_lim is calculated as a function of pedal position and engine speed, n. One example of this function ctrl_n_lim may be, for example and for a particular engine: At a zero pedal position (i.e., operator foot is removed from the accelerator) the ctrl_n_lim is 1000 rpm. When the pedal is depressed to the floor (about 15 degrees depression, in this example), ctrl_n_lim is 4500 rpm. At pedal positions between these two extremes, ctrl_n_lim is substantially linear with pedal position.

Figure 3:
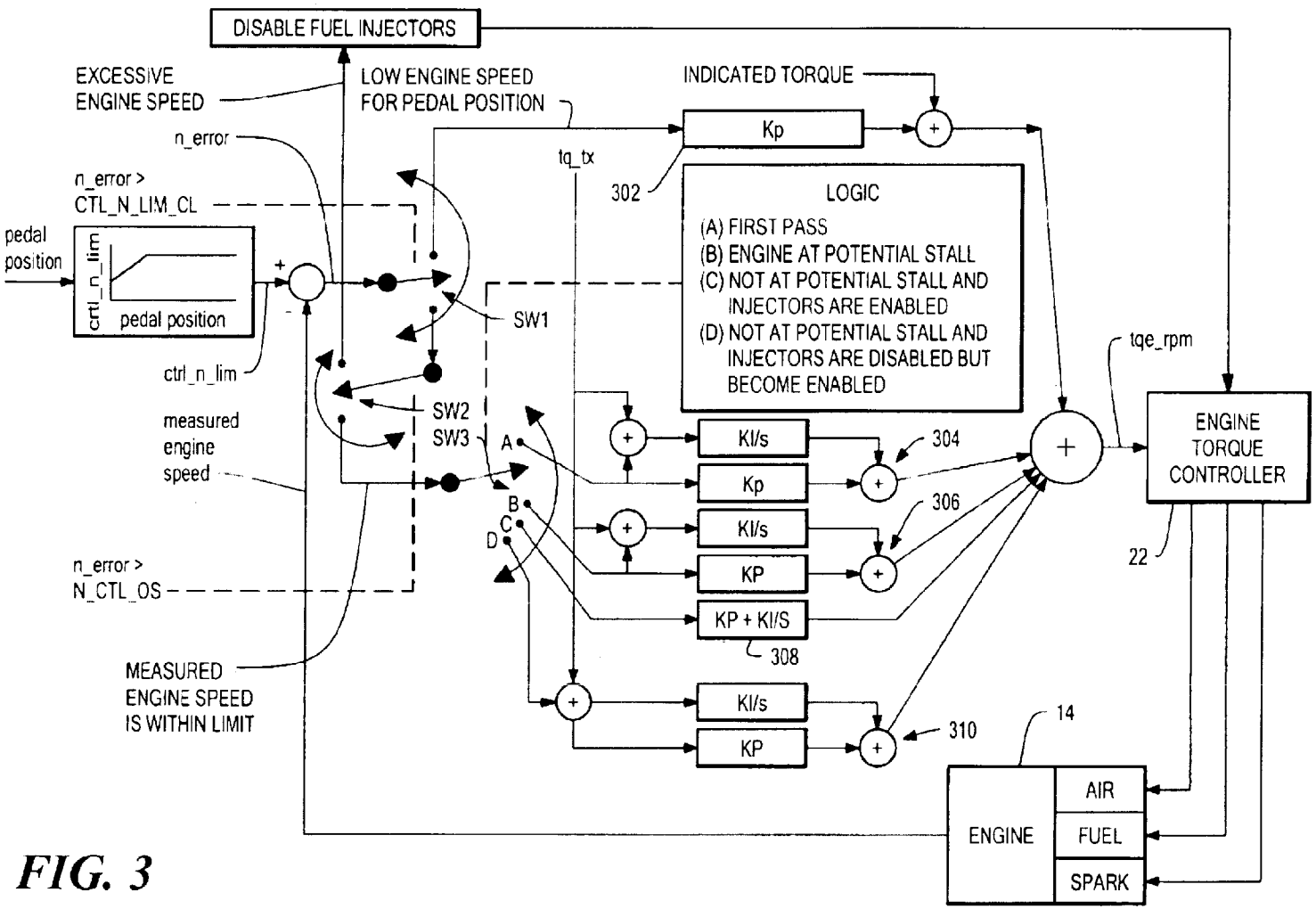
FIG. 3 is a more detailed block diagram of the engine system of FIG. 1.

Reference is made to FIG. 3. As noted therein, a feedback control system is shown. It is first noted that FIG. 3 is used for purposes of understanding and the implementation, while shown with switches, to be described, is actually implemented with an executable software program represented by a set of computer coded instructions here stored in a semiconductor chip memory in the ECU 12 (FIG. 1). Thus, referring to FIG. 3, the input to the system ctrl_n_lim is compared with the feedback signal, measured engine speed, n, to produce the error signal n_error, as described in FIG. 1. The difference between measured engine speed, n, and ctrl_n_lim (i.e., n_error=ctrl_n_lim−measured engine speed, n) is determined as described above in connection with FIG. 1 to produce the error signal n_error. This error signal, n_error, is fed to a one of a plurality of controllers 302, 304, 306, 308 and 310. Controller 302 is a proportional controller having a gain $K_I$. Each one of the controllers 304, 306, 308 and 310 includes a proportion term $K_P$ and integrating term $K_I/s$, where s is the LaPlace operator, to provide a proportional plus integral controller. It is further noted that controllers 304, 306, and 310 are shown with two separate portions; a proportional control action portion having a gain $K_P$, and an integration control action portion having a gain $K_I$. The two portions are fed by the signal $n_{13}$ error and their outputs are added to provide the signal tqe_rpm when the signal n_error is selectively coupled thereto in accordance with conditions, to be described. Here, such conditions are represented by the position of switches SW1–SW3, to be described. Suffice it to say here, however, that the integrating portion of controllers 304, 306, and 310 are initialized by determined transmission load torque, tq_tx, i.e., the torque required to turn the transmission, not shown, coupled to the engine 14 (FIG. 1).

More particularly, when measured engine speed, n, is low for the detected pedal position, the error signal $n_{13}$ error is fed via switch SW1 to the proportional action controller 302. The output of controller 302 is added to the indicated torque (tqe_ind) to produce the control signal tqe_rpm for the engine torque controller 22, as indicated.

On the other hand, when measured engine speed, n, is high for the detected pedal position, the error signal $n_{13}$ error is fed via switch SW1 to switch SW2. If the measured engine speed is excessive, the fuel injectors for the engine are all disabled. If, however, the engine speed is not excessive, switch 302 couples the error signal n_error to one of the four controllers 304, 306, 308, or 310, selectively, in accordance with a control signal provided to switch SW3 by a logic 312. More particularly, if this is the first pass through the process, the error signal n_error is coupled to controller 304 via terminal A of switch SW3. Thus, controller 304 provides the proportional plus integral action of the feedback control system, it being noted that, as described above, the integrator portion of such controller 304 uses, as its initial value, the transmission load torque tq_tx. Thus, in such condition, the output of controller 304 produces the control signal tqe_rpm for the engine torque controller 22.

If, this is the not the first pass through the process, the error signal n_error and the measured engine speed, n, is at a potential stall condition, controller 306 is to terminal B of switch SW3. Thus, controller 306 provides the proportional plus integral action of the feedback control system, it being noted that, as described above, the integrator portion of such controller 304 uses, as its initial value, the transmission load torque tq_tx. Thus, in such condition, the output of controller 306 produces the control signal tqe_rpm for the engine torque controller 22.

If, this is the not the first pass through the process and the engine is not at a potential stall condition, and the injectors are enabled, the error signal n_error controller 308 is to terminal C of switch SW3. Thus, controller 308 provides the proportional plus integral action of the feedback control system. Therefore, in such condition, the output of controller 308 produces the control signal tqe_rpm for the engine torque controller 22.

If, this is the not the first pass through the process and the engine is not at a potential stall condition, and the injectors are disabled but became enabled, the error signal n_error controller 310 is to terminal D of switch SW3. Thus, controller 310 provides the proportion plus integral action of the feedback control system provides the proportional plus integral action of the feedback control system. It is noted that, as described above, the integrator portion of such controller 310 uses, as its initial value when the injectors become enabled, the transmission load torque tq_tx. Thus, in such condition, the output of controller 310 produces the control signal tqe_rpm for the engine torque controller 22

Referring now again to FIG. 2, the flow diagram for the logic 22 (FIG. 1) is shown. Thus, at Step 202, the error signal $n_{13}$ error is calculated as described above in connection with FIG. 1. If ($n_{13}$ error>CTL_N_LIM_CL), (Step 204) where CTL_N_LIM_CL is, as noted above in connection with FIG. 3, a calibratible scalar, the current engine speed, n, is well below the allowed engine speed limit. In such case, the proportional controller 302 (FIG. 3) in the logic, provides the controller for the feedback control system (FIG. 3) and indicated torque, tq_int, is assigned the current indicated engine torque, Step 206. Thus, in Step 206, indicated torque is used for the signal tqe_rpm. This ensures that the requested brake torque (indicated torque—engine torque losses) will be greater than the current maximum output of the engine and the controller will not be reducing torque.

On the other hand, if in Step 204, it is that the current engine speed is above the allowed engine speed limit the process proceeds to Step 208. If in Step 208 it is determined that the engine speed is excessive, the process proceeds to Step 209 and the fuel injectors are turned off. On the other hand, if in Step 208, it is determined that the current engine speed is not excessive, a calculation is made of the torque required to turn the transmission, tq_tx, Step 210, and the process proceeds to Step 212.

In Step 212, a determination is made as to whether this is the first pass through the process. If so, $$\text{tqe_rpm, tqe_rpm} = \text{tqe_rpm_} + K_1 * \int_0^t \text{n_grd_error}(dt) + K_p * \text{n_error},$$

i.e., controller 304 in FIG. 2, Step 213.

If, however, in Step 212 it is determined that this is not the first pass, a determination is made in Step 214 as to whether the engine is at a potential stall speed. If it is, the process proceeds to Step 216 and $$\text{tqe_rpm} = \text{tqe_rpm} = \text{tqe_rpm} + K_1 * \int_0^t \text{n_grd_error}(dt) + K_p * \text{n_error},$$

i.e., controller 306 in FIG. 2.

If, on the other hand, the engine speed is not at a stall condition, the process proceeds to Step 218. If, in Step 218, it is determined that the fuel injectors are enabled, $$\text{tqe_rpm} = K_1 * \int_0^t \text{n_grd_error}(dt) + K_p * \text{n_error},$$

Step 219. Thus, controller 308 (FIG. 3) is used.

On the other hand, if in Step 218 it is determined that the fuel injectors are not enabled, the process proceeds to Step 220. In this case, when the injectors are enabled, the initial torque used is $$\text{tqe_tx, i.e., , tqe_rpm} = \text{tqe_rpm} + K_1 * \int_0^t \text{n_grd_error}(dt) + K_p * \text{n_error}.$$

Thus, controller 310 (FIG. 3) is used.

Figure 4A:
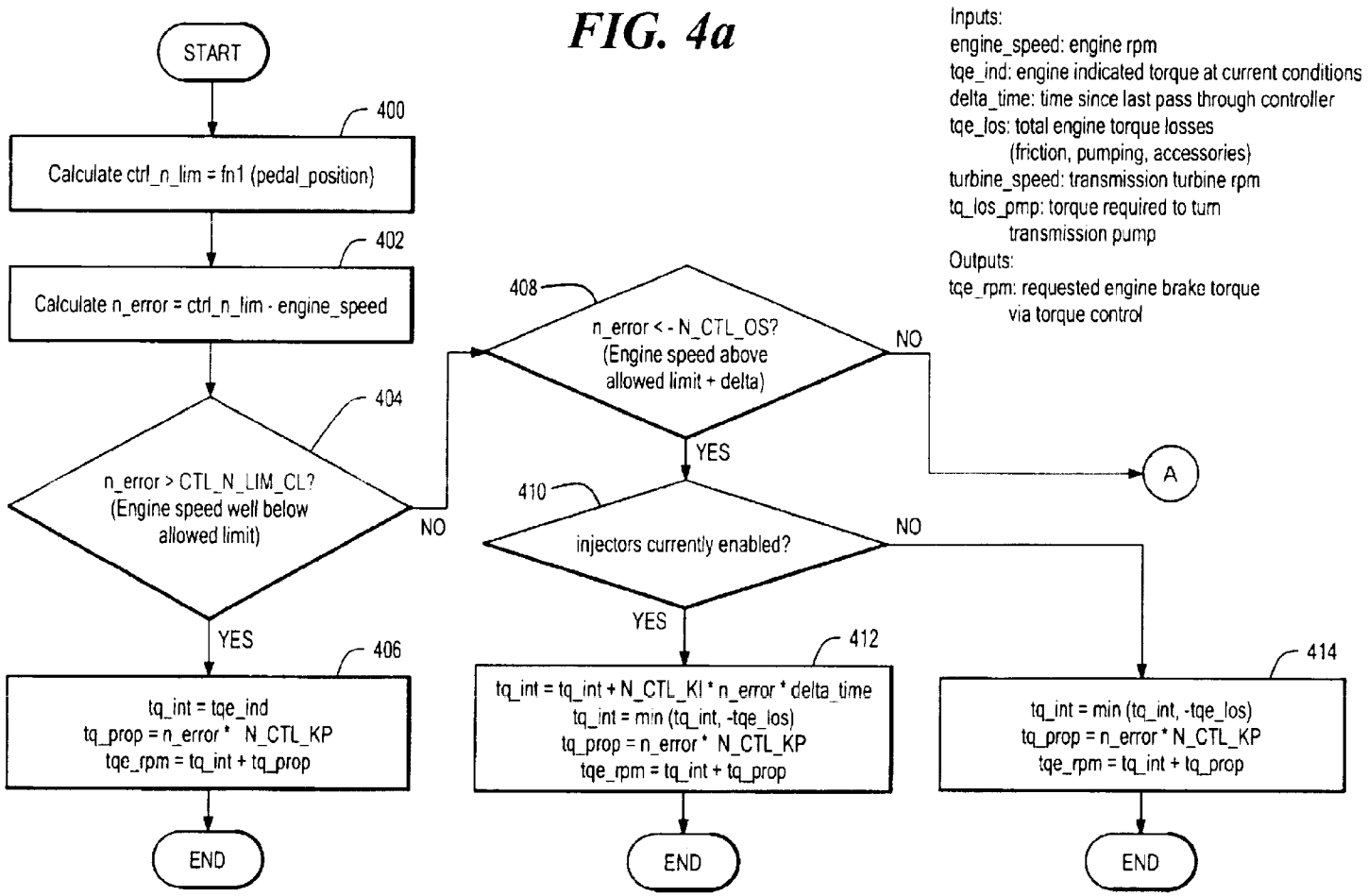
FIGS. 4A and 4B is more detailed flow diagram of FIG. 2, such flow diagram performed by logic included in the engine system of FIG. 3.
Figure 4B:
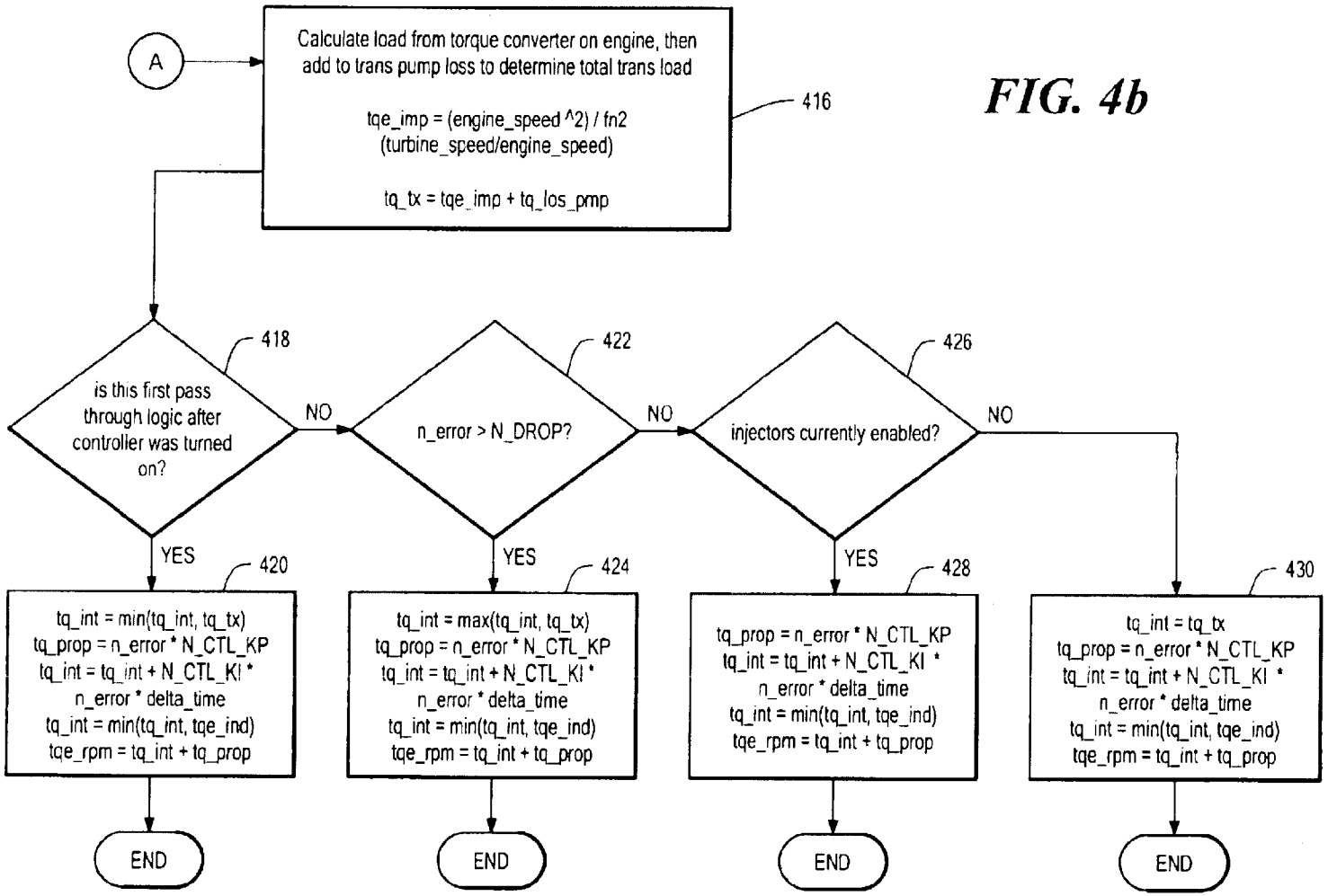

Referring now to FIGS. 4A and 4B a more detailed flow diagram of the process is shown. Thus, in Step 400, a calculation is made of ctrl_n_lim as a function of pedal position. In Step 402, n_error is calculated as: n_error= ctrl_n_lim=engine_speed. In Step 404 a determination is made as to whether n_error>CTL_N_LIM_CL, (i.e., is engine speed well below the allowed limit?) If n_error is>CTL_N_LIM_CL, the process proceeds to Step 406. In this case, tq_int=tqe_ind;

tq_prop=n_error*N_CTL_KP; and tqe_rpm=tq_int+tq_prop;

where:

engine_speed is engine rpm;

tqe_ind is engine indicated torque; and tqe_rpm is requested engine brake torque.

If, in Step 404, it is determined that n_error is not greater than a predetermined allowed speed, CTL_N_LIM_CL, the process proceeds to Step 408.

In Step 408 a determination is made as to whether n_error is greater than N_OS (i.e., above the allowed speed, CTL_N_LIM_CL, plus a predetermined additional amount). If so, the speed is considered excessive and the process proceeds to Step 410.

In Step 410, a determination is made as to whether the fuel injectors are enabled. If they are enabled, the process proceeds to Step 412. In Step 412 the following is performed:

tq_int=tq_int+N_CTL_KI*$n_{13}$ error*delta_time tq_int=min(tq_int, −tqe_los)

tq_prop=$n_{13}$ error=$n_{13}$ error*N_CTL+KP tqe_rpm=tq_int+tq_prop;

where:

tqe_los is total engine torque losses (friction, pumping, accessories)

delta_time—time since last pass through controller.

It is noted that in Step 410 the torque signal tqe_rpm is updated to no more that that which would have been produced with all fuel injectors disabled. That is, the integral element is clipped, or limited, to be no more than the brake torque produced with all injectors (i.e., disabled), i.e., tq_int=min(tq_int, −tqe_los); where tqe_los is the total torque losses on the engine. Thus, the calculated torque signal tqe_rpm is ensured to be less than the minimum (all injectors off) possible torque.

If, in Step 410, a determination is that made as to whether the fuel injectors are not enabled, the process proceeds to Step 414. In Step 414 the following is performed:

tqe_int=min(tq_int,−tqe_los)

tq_prop=n_error+N_CTL_KP tqe_rpm=tq_int+tq_prop.

It is again noted that the torque signal tqe_rpm is updated to no more that that which would have been produced with all fuel injectors disabled. That is, the integral element is clipped, or limited, to be no more than the brake torque produced with all injectors (i.e., disabled), i.e., tq_int=min (tq_int, −tqe_los); where tqe_los is the total torque losses on the engine. Thus, the calculated torque signal tqe_rpm is ensured to be less than the minimum (all injectors off) possible torque.

In Step 408 a determination that n error is not greater than N_OS (i.e., above the allowed speed, CTL_N_LIM_CL, plus a predetermined additional amount), i.e., the speed is not considered excessive, the process proceeds to Step 416.

In Step 416, a calculation is made from the torque converter, not shown in FIG. 1, coupled to the engine. Transmission pump losses is then added to the calculated torque converter load:

tqe_imp=(engine_speed)$^2$/a function, fn, of (turbine_speed/engine_speed)

Also calculated is:

tq_tx=tqe_imp+tq_los_pump;

where:

tq_los_pmp is the torque required to turn the transmission pump.

The process then proceeds to Step 418. In Step 418, a determination is made as to whether this is the first pass through the logic after the controller was turned on. If it is, the process proceeds to Step 420. In Step 420, the following are calculated:

tq int=min(tq_int, tq_tx)

tq_pmp=n___error*N_CTL_KP tq_int=tq_int+N_CTL_KI*n_error*delta_time tq_int=min(tq_int, tqe_ind)

tqe_rpm=tq_int+tq_prop.

If in Step 418, a determination is made as that this is not the first pass through the logic after the controller was turned on, the process proceeds to Step 422. In Step 422, a determination is made as to whether n_error is greater than N_DROP. That is, the process determines whether the engine speed is well below the limit (N_DROP). If it is, the process proceeds to Step 424. In Step 424, the following are calculated:

tq_int=max(tq_int, tq_tx)

tq_pmp=n_error*N_CTL_KP tq_int=tq_int+N_CTL_KI*$n_{13}$ error*delta_time tq___int=min(tq_int, tqe_ind)

tqe_rpm=t_int+tq_prop.

Thus, if the engine speed is well below the guard limit, the process insures that the integral element is limited to no less than the torque only required to turn the transmission, i.e., tq_int=max(tq_int, tq_tx).

If in Step 422, a determination is made that n_error is not greater than N_DROP, the process proceeds to Step 426. In Step 426 a determination is made as to whether all the fuel injectors are currently enabled. If they are enabled, the process proceeds to Step 428. In Step 428, the following calculations are made:

tq_pmp=n_error*N_CTL_KP tq_int=tq_int+N_CTL_KI*n_error*delta_time tq_int=min(tq_int, tqe_ind)

tqe_rpm=tq_int+tq_prop.

If in Step 426 it is determined that the fuel injectors are currently not enabled but can be enabled, the process proceeds to Step 430. In Step 430, the following calculations are made:

tq_int=tq_tx tq_pmp=n_error*N_CTL_KP tq_int=tq_int+N_CTL_KI*n_error*delta_time tq_int=min(tq_int, tqe_ind)

tqe_rpm=tq_int+tq_prop.

Thus, in this condition, a best guess is made using the torque required to maintain the engine at is current operating speed based on the torque required to turn the engine. i.e., tq_int=tq_tx.

A number of embodiments of the invention have been described. Nevertheless, it will be understood that various modifications may be made without departing from the spirit and scope of the invention. For example, the engine speed limit ctrl_n_lim could also be determined using other inputs such as time since engine start, brake pedal position, brake pressure, time since entering AM mode. The controller could estimate the torque loads on the engine from the transmission using desired engine speeds or predicted engine speeds or via other methods. Accordingly, other embodiments are within the scope of the following claims.

What is claimed is:

1. An engine speed control method, comprising:

(a) determining a range of allowable engine speeds, such range extending from a low limit, LOW_LIM=cnt_ n_lim−$K_1$ to a high limit, LIM_HIGH=cnt_n_lim+$K_2$, where $K_1$ and $K_2$ are predetermined constants, and cnt_n_lim is a function of operator input;

(b) calculating an error, n_error, between measured engine speed and ctrl_n_lim; and (c) feeding the error to a feedback controller, such controller producing an engine brake torque, tqe_rpm, command for the engine, such controller disabling engine fuel injection when the measured engine speed is greater than LIM_HIGH and enabling fuel injection if the measured speed is within the range.

2. The method recited in claim 1 including:

calculating a torque, tq_tx, on the engine from a transmission coupled to the engine; and wherein, when measured engine speed decreases from a speed greater than LIM_HIGH, wherein fuel injection was disabled, to within the range, the controller enabling fuel injection and providing, as an initial value for the engine brake command torque, the calculated torque, tq_tx.

3. The method recited in claim 2 wherein the controller provides proportional plus integral control action of the error, and wherein the integral action is initialized with the calculated torque to provide the initial value for the engine command torque.

4. The method recited in claim 1 including:

calculating a torque, tq_tx, on the engine from a transmission coupled to the engine;

determining whether measured engine speed is a potential stall speed; and wherein, if measured engine speed is within the range and such measured engine speed is a potential stall speed, having the controller operate to maintain tq_tx as the engine brake torque command to the engine.

5. The method recited in claim 4 wherein the controller provides proportional plus integral control action on the error, and wherein the integral action is clipped to maintain at least tq_tx as the engine brake torque command to the engine.

6. The method recited in claim 1 including:

calculating a torque, tq_tx, on the engine from a transmission coupled to the engine;

determining whether measured engine speed is a potential stall speed; and wherein, if measured engine speed is greater than a potential stall speed, and if the fuel injection was not disabled, having the controller operate to provide proportional plus integral operation on the error in providing the engine brake torque command to the engine.

7. An engine speed control method, comprising:

determining a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input;

calculating an error, n_error, between measured engine speed and ctrl_n_lim; and feeding the error to a feedback controller, such controller producing an engine brake torque, tqe_rpm, command for the engine;

calculating a torque load, tq_tx, on the engine from a transmission coupled to the engine; and at least one of initializing such brake torque and such brake torque, tqe_rpm, command as a function of the calculated torque, tq_tx.

8. The method recited in claim 7 including:

wherein, when measured engine speed decreases from a speed greater than LIM_HIGH, wherein fuel injection was disabled, to within the range, the controller enabling fuel injection and providing, as an initial value for the engine brake command torque, the calculated torque, tq_tx.

9. The method recited in claim 8 wherein the controller provides proportional plus integral control action of the error, and wherein the integral action is initialized with the calculated torque to provide the initial value for the engine command torque.

10. The method recited in claim 7 including:

determining whether measured engine speed is a potential stall speed; and wherein, if measured engine speed is within the range and such measured engine speed is a potential stall speed, having the controller operate to maintain tq_tx as the engine brake torque command to the engine.

11. The method recited in claim 10 wherein the controller provides proportional plus integral control action on the error, and wherein the integral action is clipped to maintain at least tq_tx as the engine brake torque command to the engine.

12. The method recited in claim 7 including:

determining whether measured engine speed is a potential stall speed; and wherein, if measured engine speed is greater than a potential stall speed, and if the fuel injection was not disabled, having the controller operate to provide proportional plus integral operation on the error in providing the engine brake torque command to the engine.

13. A system, comprising:

an internal combustion engine;

a transmission coupled to such engine;

a control unit, such control unit having a feedback controller for providing a producing an engine brake torque, tqe_rpm, command for the engine in response to a torque command, such control unit being programmed to:

determine a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input, for calculating an error, n_error, between measured engine speed and ctrl_n_lim; and feed the error to the feedback controller, such controller, such controller disabling engine fuel injection when the measured engine speed is greater than LIM_HIGH and enabling fuel injection if the measured speed is within the range.

14. The system recited in claim 13 wherein the control unit is programmed to:

calculate a torque, tq_tx, on the engine from a transmission coupled to the engine, and when measured engine speed decreases from a speed greater than LIM_HIGH, wherein fuel injection was disabled, to within the range, enabling fuel injection and providing, as an initial value for the engine brake command torque, the calculated torque load, tq_tx.

15. The system recited in claim 14 wherein the controller provides proportional plus integral control action of the error, and wherein the integral action is initialized with the calculated torque to provide the initial value for the engine command torque.

16. The system recited in claim 13 wherein the control unit is programmed to:

calculate a torque, tq_tx, on the engine from a transmission coupled to the engine;

determine whether measured engine speed is a potential stall speed; and wherein, if measured engine speed is within the range and such measured engine speed is a potential stall speed, having the controller operate to maintain tq_tx as the engine brake torque command to the engine.

17. The system recited in claim 16 wherein the controller provides proportional plus integral control action on the error, and wherein the integral action is clipped to maintain at least tq_tx as the engine brake torque command to the engine.

18. The system recited in claim 16 wherein the control unit is programmed to:

calculate a torque load, tq_tx, on the engine from a transmission coupled to the engine;

determine whether measured engine speed is a potential stall speed; and wherein, if measured engine speed is greater than a potential stall speed, and if the fuel injection was not disabled, having the controller operate to provide proportional plus integral operation on the error in providing the engine brake torque command to the engine.

19. A system, comprising:

a control unit programmed to:

determine a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input;

calculate an error, between measured engine speed and ctrl_n_lim; and feed the error to a feedback controller, such controller producing an engine brake torque, tqe_rpm, command for the engine;

calculate a torque, tq_tx, on the engine from a transmission coupled to the engine; and at least one of: (a) initialize such brake torque; (b) and limit such brake torque, tqe_rpm, command as a function of the calculated torque, tq_tx.

20. The system recited in claim 19 wherein the control unit is programmed to:

when measured engine speed decreases from a speed greater than LIM_HIGH, wherein fuel injection was disabled, to within the range, the controller enabling fuel injection and providing, as an initial value for the engine brake command torque, the calculated torque load, tq_tx.

21. The system recited in claim 20 wherein the controller provides proportional plus integral control action of the error, and wherein the integral action is initialized with the calculated torque to provide the initial value for the engine command torque.

22. The system recited in claim 19 wherein the control unit is programmed to:

determine whether measured engine speed is a potential stall speed; and wherein, if measured engine speed is within the range and such measured engine speed is a potential stall speed, having the controller operate to maintain tq_tx as the engine brake torque command to the engine.

23. The system recited in claim 22 wherein the controller provides proportional plus integral control action on the error, and wherein the integral action is clipped to maintain at least tq_tx as the engine brake torque command to the engine.

24. The system recited in claim 19 wherein the control unit is programmed to:

determine whether measured engine speed is a potential stall speed; and if measured engine speed is greater than a potential stall speed, and if the fuel injection was not disabled, having the controller operate to provide proportional plus integral operation on the error in providing the engine brake torque command to the engine.

25. A computer executable storage medium having a computer executable program which when executed provides an engine speed control method, such exeecuted program:

determining a range of allowable engine speeds, such range extending from a low limit, LOW_LIM=cnt_n_lim−$K_1$ to a high limit, LIM_HIGH=cnt_n_lim+$K_2$, where $K_1$ and $K_2$ are predetermined constants, and cnt_n_lim is a function of operator input;

calculating an error, n_error, between measured engine speed and ctrl_n_lim; and feeding the error to a feedback controller, such controller producing an engine brake torque, tqe_rpm, command for the engine, such controller disabling engine fuel injection when the measured engine speed is greater than LIM_HIGH and enabling fuel injection if the measured speed is within the range.

26. The storage medium recited in claim 25 wherein such medium is a semiconductor chip.

* * * * *